US007603052B2

(12) United States Patent
Honobe et al.

(10) Patent No.: US 7,603,052 B2
(45) Date of Patent: Oct. 13, 2009

(54) CLEANING DEVICE AND IMAGE FORMING APPARATUS

(75) Inventors: Satoshi Honobe, Kanagawa (JP); Hideaki Ohike, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 455 days.

(21) Appl. No.: 11/511,480

(22) Filed: Aug. 29, 2006

(65) Prior Publication Data

US 2007/0177891 A1 Aug. 2, 2007

(30) Foreign Application Priority Data

Feb. 1, 2006 (JP) ..... 2006-024653

(51) Int. Cl.
*G03G 15/02* (2006.01)

(52) U.S. Cl. ..... 399/100

(58) Field of Classification Search ..... 399/100, 399/174, 176

See application file for complete search history.

(56) References Cited

U.S. PATENT DOCUMENTS 7,454,154 B2 * 11/2008 Matsumoto et al. ..... 399/100
7,474,864 B2 * 1/2009 Kobayashi et al. ..... 399/100
2004/0228648 A1 11/2004 Yanagida et al.
2006/0165431 A1 7/2006 Yanagida et al.

FOREIGN PATENT DOCUMENTS

| | | |
|---|---|---|
| CN | 1550933 A | 12/2004 |
| JP | 64-035464 | 2/1989 |
| JP | 09-096952 | 4/1997 |
| JP | 10-003202 | 1/1998 |
| JP | 10-171246 | 6/1998 |
| JP | 2002-196568 | 7/2002 |
| JP | A-2002-39783 | 7/2002 |
| JP | 2003-165662 | 6/2003 |
| JP | 2005-128584 | 5/2005 |

* cited by examiner

*Primary Examiner*—William J Royer
(74) *Attorney, Agent, or Firm*—Morgan, Lewis & Bockius LLP

(57) ABSTRACT

An image forming apparatus, including: an image carrier that carries an image; a charge roll that charges the image carrier; and a cleaning member that contacts the charge roll and cleans the charge roll, wherein the cleaning member is configured to include a surface layer that is formed by an elastic body and contacts the charge roll, an inner layer that is configured by an elastic body softer than the surface layer and supports the surface layer, and a support member that supports the inner layer and causes the surface layer to contact the charge roll.

10 Claims, 10 Drawing Sheets

CLEANING DEVICE AND IMAGE FORMING APPARATUS

BACKGROUND

1. Technical Field

The present invention relates to an image forming apparatus that employs an electrophotographic system, such as a copier and a printer.

2. Related Art

Conventionally, devices that utilize a corona discharge phenomenon, such as scorotron chargers, have come to be widely used as charge devices in image forming apparatus that employ the electrophotographic system, such as copiers and printers. But in the case of charge devices utilizing the corona discharge phenomenon, the occurrence of ozone and nitrogen oxide, which are harmful to humans and Earth's environment, is becoming a problem. In contrast, contact charging, where a conductive charge roll is brought into direct contact with an image carrier to charge the image carrier, has become mainstream in recent years because there are considerably few occurrences of ozone and nitrogen oxide and it is power-efficient.

SUMMARY

According to an aspect of the invention, there is provided an image forming apparatus including: an image carrier that carries an image; a charge roll that charges the image carrier; and a cleaning member that contacts the charge roll and cleans the charge roll, wherein the cleaning member is configured to include a surface layer that is formed by an elastic body and contacts the charge roll, an inner layer that is configured by an elastic body softer than the surface layer and supports the surface layer, and a support member that supports the inner layer and causes the surface layer to contact the charge roll.

BRIEF DESCRIPTION OF THE DRAWINGS

Exemplary embodiments of the present invention will be described in detail based on the following figures, wherein.

DETAILED DESCRIPTION

An image forming apparatus pertaining to an exemplary embodiment of the present invention will be described below with reference to the drawings.

Figure 1:
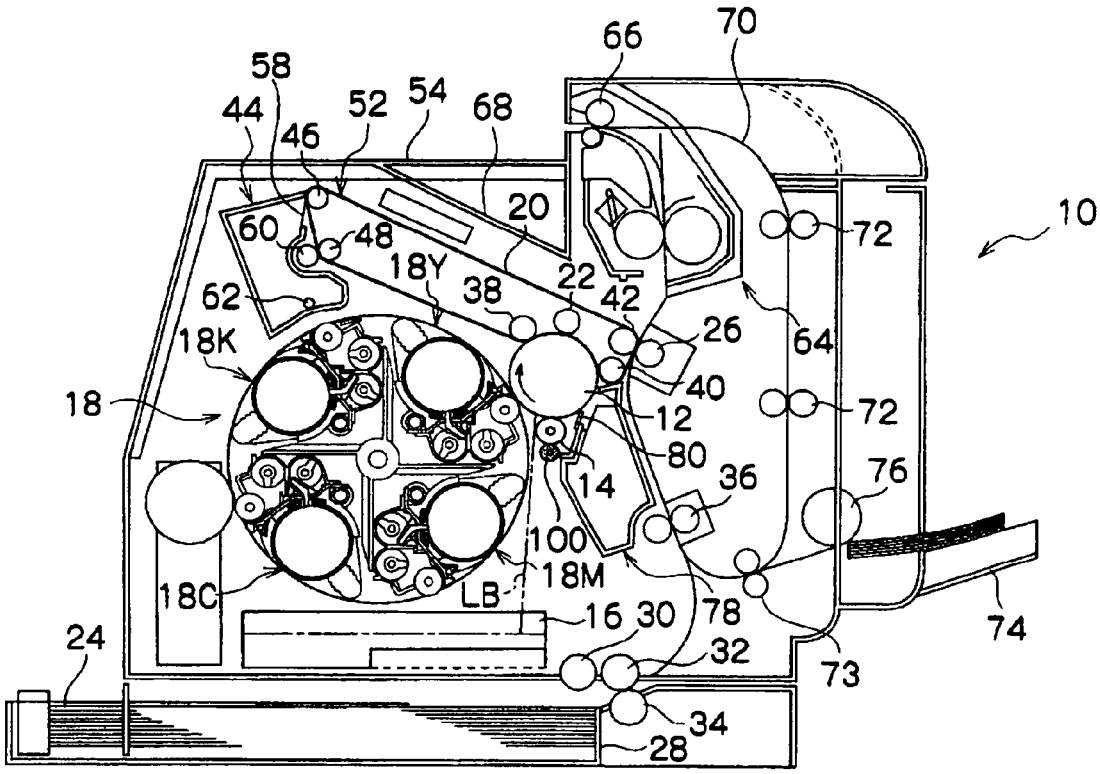
FIG. 1 is a configurational diagram showing the general configuration of an image forming apparatus pertaining to an exemplary embodiment of the invention.

An image forming apparatus 10 of the present exemplary embodiment shown in FIG. 1 is a 4-cycle full-color laser printer. As is shown, a photoconductor drum 12 (image carrier) is rotatably disposed in the apparatus 10 in the somewhat upper right portion from the center. A conductive cylinder whose diameter of about 47 mm and whose surface is covered with a photoconductor layer formed with an organic photoconductive photoreceptor (OPC) or the like, for example, is used as the photoconductor drum 12. The photoconductor drum 12 is driven to rotate by an unillustrated motor at a process speed of about 150 mm/sec along the direction indicated by the arrow.

The surface of the photoconductor drum 12 is charged to a predetermined electric potential by a charge roll 14 disposed substantially directly under the photoconductor drum 12. Thereafter, the surface of the photoconductor drum 12 is exposed to a laser beam LB by an exposure device 16 disposed under the charge roll 14, whereby an electrostatic latent image corresponding to image information is formed on the surface of the photoconductor drum 12.

The electrostatic latent image formed on the photoconductor drum 12 is developed by a rotary developing unit 18 that includes developing units 18Y, 18M, 18C, and 18K of the respective colors of yellow (Y), magenta (M), cyan (C), and black (K) disposed along the circumferential direction of the rotary developing unit 18, and the electrostatic latent image becomes a predetermined color toner image.

At this time, each of the steps of charging, exposing, and developing is repeated a predetermined number of times on the surface of the photoconductor drum 12 in correspondence to the colors of the image to be formed. In the developing step, the rotary developing unit 18 rotates such that the developing units 18Y, 18M, 18C, and 18K of the corresponding colors move to a development position facing the photoconductor drum 12.

For example, when a full-color image is to be formed, each of the steps of charging, exposing, and developing is repeated four times on the surface of the photoconductor drum 12 in correspondence to the respective colors of yellow, magenta, cyan, and black, and toner images corresponding to the respective colors of yellow, magenta, cyan, and black are sequentially formed on the surface of the photoconductor drum 12. When the toner images are formed, the number of times that the photoconductor drum 12 rotates differs in accordance with the size of the image. For example, if the recording medium on which the image is to be formed is A4-size, the photoconductor drum 12 rotates three times, whereby one image is formed. In order words, each time the photoconductor drum 12 rotates three times, a toner image corresponding to the respective colors of yellow, magenta, cyan, and black is formed on the surface of the photoconductor drum 12.

The toner images of the respective colors of yellow, magenta, cyan, and black sequentially formed on the photoconductor drum 12 are transferred, at a first transfer position where an intermediate transfer belt 20 is wrapped around the outer periphery of the photoconductor drum 12, by a first transfer roll 22 in a state where the toner images are mutually superposed on the intermediate transfer belt 20.

The toner images of yellow, magenta, cyan, and black multiply transferred onto the intermediate transfer belt 20 are transferred all at once by a second transfer roll 26 onto recording paper 24 fed at a predetermined timing.

The recording paper 24 is sent by a pickup roll 30 from a paper supply cassette 28 disposed in the lower portion of the image forming apparatus 10, separated one sheet at a time and supplied by a feed roll 32 and a retard roll 34, and transported to a second transfer position of the intermediate transfer belt 20 in a state synchronized by a registration roll 36 with the toner images transferred onto the intermediate transfer belt 20.

The intermediate transfer belt 20 is stretched at a predetermined tension by: a wrap-in roll 38 that defines a wrap position of the intermediate transfer belt 20 upstream in the rotational direction of the photoconductor drum 12; the first transfer roll 22 that transfers the toner images formed on the photoconductor drum 12 onto the intermediate transfer belt 20; a wrap-out roll 40 that defines a wrap position of the intermediate transfer belt 20 downstream of the wrap position; a backup roll 42 that contacts the second transfer roll 26 via the intermediate transfer belt 20; a first cleaning backup roll 46 that faces a cleaning device 44 of the intermediate transfer belt 20; and a second cleaning backup roll 48. The intermediate transfer belt 20 follows the rotation of the photoconductor drum 12, for example, such that it circulates and moves at the predetermined process speed (about 150 mm/sec).

Here, the intermediate transfer belt 20 is configured such that the cross-sectional shape formed by the stretched intermediate transfer belt 20 has a flat, slender, substantially trapezoidal shape in order to make the image forming apparatus 10 compact.

An image forming unit 52 is integrally configured by: the photoconductor drum 12; the charge roll 14; the intermediate transfer belt 20; the plural rolls 22, 38, 40, 42, 46, and 48 that stretch the intermediate transfer belt 20; the cleaning device 44 for the intermediate transfer belt 20; and a later-described cleaning device 78 for the photoconductor drum 12. For this reason, the entire image forming unit 52 can be removed from the image forming apparatus 10 by opening an upper cover 54 of the image forming apparatus 10 and lifting up by hand a handle (not shown) disposed in the upper portion of the image forming unit 52.

The cleaning device 44 of the intermediate transfer belt 20 includes a scraper 58, which is disposed such that it contacts the surface of the intermediate transfer belt 20 stretched by the first cleaning backup roll 46, and a cleaning brush 60, which is disposed such that it presses against the surface of the intermediate transfer belt 20 stretched by the second cleaning backup roll 48. Residual toner and paper dust removed by the scraper 58 and the cleaning brush 60 are collected inside the cleaning device 44.

It will be noted that the cleaning device 44 is configured such that it is pivotable about a pivot shaft 62 in the counterclockwise direction of FIG. 1, is withdrawn to a position away from the surface of the intermediate transfer belt 20 until second transfer of the toner image of the final color ends, and contacts the surface of the intermediate transfer belt 20 when second transfer of the toner image of the final color ends.

Moreover, the recording paper 24 to which the toner images have been transferred from the intermediate transfer belt 20 is transported to a fixing device 64, where the recording paper 24 is heated and pressured by the fixing device 64 such that the toner images are fixed to the recording paper 24. Thereafter, in the case of one-sided printing, the recording paper 24 to which the toner images have been fixed is discharged by a discharge roll 66 into a discharge tray 68 disposed in the upper portion of the image forming apparatus 10.

In the case of two-sided printing, the recording paper 24 to which the toner images have been fixed to a first side (front side) by the fixing device 64 is not discharged by the discharge roll 66 into the discharge tray 68; rather, the trailing end portion of the recording paper 24 is nipped by the discharge roll 66, the discharge roll 66 is reversely rotated, the transportation path of the recording paper 24 is switched to a two-sided paper transportation path 70, the front and back sides of the recording paper 24 are inverted by a transportation roll 72 disposed in the two-sided paper transportation path 70, the recording paper 24 is again transported to the second transfer position of the intermediate transfer belt 20, and the toner images are transferred to the second side (back side) of the recording paper 24. Then, the toner images on the second side (back side) of the recording paper 24 are fixed by the fixing device 64 and the recording paper 24 is discharged into the discharge tray 68.

Moreover, a manual-feed tray 74 can be optionally loaded in the side of the image forming apparatus 10 such that the manual-feed tray 74 can be freely opened and closed. Recording paper 24 of optional sizes and types disposed in the manual-feed tray 74 is supplied by a paper supply roll 76 and transported to the second transfer position of the intermediate transfer belt 20 via a transportation roll 73 and the registration roll 36, so that images can be formed on recording paper 24 of optional sizes and types.

It will be noted that each time the photoconductor drum 12 rotates one time, residual toner and paper dust are removed from the surface of the photoconductor drum 12 after the step transferring the toner images has ended by a cleaning blade 80 of the cleaning device 78 disposed diagonally below the photoconductor drum 12, so that the photoconductor drum 12 is prepared for the next image forming step.

Figure 2:
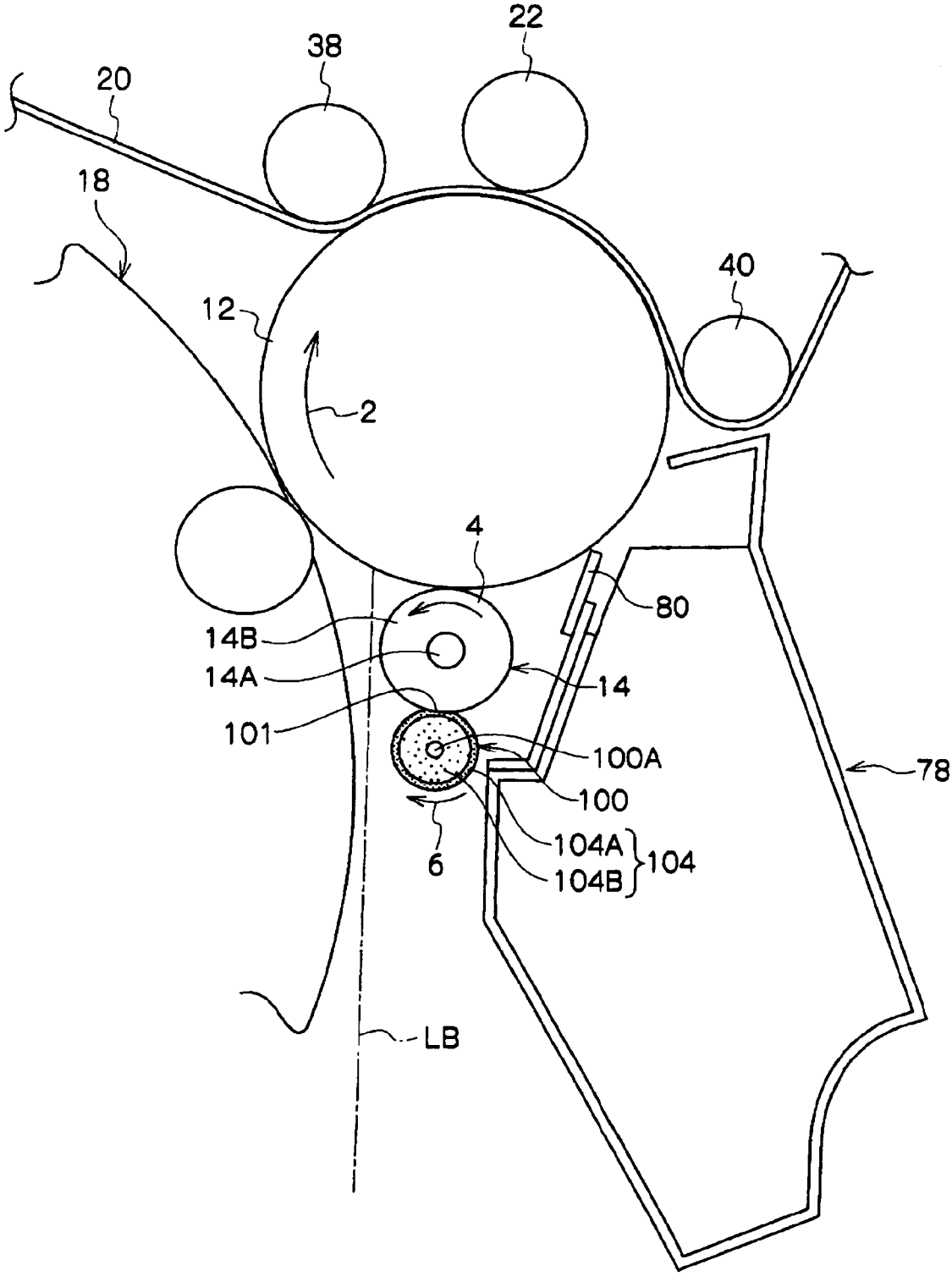
FIG. 2 is an enlarged view showing the configuration of a photoconductor drum, a charge roll and a cleaning roll disposed in the image forming apparatus of FIG. 1.

As shown in FIG. 2, the charge roll 14 is disposed under the photoconductor drum 12 such that it contacts the photoconductor drum 12. The charge roll 14 (charge member) has a conductive shaft 14A on whose periphery a charge layer 14B is formed, and the shaft 14A is rotatably supported. A roll-like cleaning roll 100 (elastic member) that contacts the surface of the charge roll 14 is disposed under the charge roll 14 opposite from the photoconductor drum 12.

A shaft 100A is disposed in the axial core of the cleaning roll 100, and the shaft 100A is rotatably supported. A sponge 104 is disposed on the outer peripheral surface of the shaft 100A, and the sponge 104 has a two-layer structure with different hardnesses. The hardness of the surface of the sponge 104 is 127 to 166 N, for example, which is harder than the hardness (e.g., hardness of 29.4 to 68.6 N) of the axial core of the sponge 104. Below, the surface of the sponge 104 will be referred to as a surface layer 104A, and the inside of the sponge 104 will be referred to as an inner layer 104B.

The "hardness" used in the present invention means pressure at the time of 25% compression of the original thickness (in the case of the present invention, when the thickness becomes 75 mm) when a measurement object (in the case of the present invention, a sponge) with a thickness of 100 mm is pressed by a columnar pressing member with a diameter of 200 mm.

Additionally, the cleaning roll 100 is pressed with a predetermined load against the charge roll 14, and the sponge 104 is elastically deformed along the circumferential surface of the charge roll 14 to form a nip portion 101. The photoconductor drum 12 is driven to rotate in the clockwise direction of FIG. 2 (the direction of arrow 2) by the unillustrated motor, and the charge roll 14 is rotated in the direction of arrow 4 by the rotation of the photoconductor drum 12. Further, the roll-like cleaning roll 100 is rotated in the direction of arrow 6 by the rotation of the charge roll 14.

Further, a charge-use power supply is connected to the charge roll 14, and bias in which alternating current is superposed on direct current, or just direct current bias, is applied. The application of bias to the cleaning roll 100 is not particularly prescribed, but in the present invention, the shaft 14A of the charge roll 14 and the shaft 100A of the cleaning roll 100 are rotatably supported by the same bearings (described later), and the cleaning roll 100 has the same electric potential as the charge roll 14.

Additionally, because the cleaning roll 100 is rotated following the rotation of the charge roll 14, contamination (foreign matter) such as toner and external additive adhering to the surface of the charge roll 14 is cleaned off by the cleaning roll 100. Additionally, this foreign matter is collected inside cells in the foam of the cleaning roll 100, and it is thought that when the foreign matter collected inside the cells clumps together and becomes an appropriate size, the foreign matter is returned to the photoconductor drum 12 from the cleaning roll 100 via the charge roll 14 and collected by the cleaning device 78 that cleans the photoconductor drum 12, whereby cleaning performance is maintained and continued.

In regard to the cleaning roll 100 serving as an elastic member of the charge roll 14, free-cutting steel or stainless steel is used as the material of the shaft 100A. The material and surface treatment method are timely selected in accordance with the purpose, such as slidability. Material that is not conductive may be treated by a common treatment such as plating to make it conductive, or may of course be used as is.

Further, because the cleaning roll 100 contacts the charge roll 14 with an appropriate nip pressure via the sponge 104, a material having strength where there is little bending at the time of nipping and a shaft diameter having sufficient rigidity with respect to the shaft length are selected.

The surface layer 104A and the inner layer 104B of the sponge 104 are made of a foam body having a porous three-dimensional structure. The material of the sponge 104 is selected from a material including foam resin or rubber such as polyurethane, polyethylene, polyamide, or polypropylene. Further, polyurethane, which has strong tearing strength and strong tensile strength, is particularly preferably used for the sponge 104 in order to ensure that the sponge 104 effectively cleans foreign matter such as the external additive adhering by following the rotation of and rubbing the charge roll 14, that the surface of the charge roll 14 is not damaged by the rubbing of the sponge 104, and that breakage and damage do not occur over a long period of time.

Further, the charge roll 14 has the conductive shaft 14A on which a cylindrical conductive elastic layer and a surface layer are sequentially formed as the charge layer 14B.

Free-cutting steel or stainless steel is used as the material of the shaft 14A. The material and surface treatment method are timely selected in accordance with the purpose, such as slidability. Material that is not conductive may be treated by a common treatment such as plating to make it conductive.

The conductive elastic layer configuring the charge layer 14B of the charge roll 14 contains an elastic material such as rubber and a conductive material such as carbon black or an ion conductive material that adjusts the resistance of the conductive elastic layer. Materials that can ordinarily be added to rubber—such as a softening agent, a plasticizing agent, a hardening agent, a vulcanizing agent, a vulcanization accelerating agent, an anti-aging agent, and a filling agent such as silica and calcium carbonate—may also be added as needed. The charge layer 14B is formed by covering the peripheral surface of the conductive shaft 14A with a mixture to which materials ordinarily added to rubber have been added. A conductive agent in which is dispersed a material that conducts electricity using electrons and/or ions as charge carriers—such as carbon black arranged in a matrix material or an ion conductive agent—can be used as a conductive agent for the purpose of adjusting the resistance. Further, the elastic material may be a foam body.

The surface layer configuring the charge layer 14B is formed in order to prevent contamination by foreign matter such as toner. The material of the surface layer is not particularly limited; resin or rubber, for example, may be used. Examples include polyester, polyimide, copolymer nylon, silicone resin, acrylic resin, polyvinyl butyral, ethylene-tetrafluoroethylene copolymer, melamine resin, fluoro-rubber, epoxy resin, polycarbonate, polyvinyl alcohol, cellulose, polyvinylidene chloride, vinyl chloride, polyethylene, and ethylene vinyl-acetate copolymer.

Further, a conductive material can be added to the surface layer to adjust the resistance. It is preferable for the conductive material to be one whose particle diameter is 3 μm or less.

Further, a conductive agent in which is dispersed a material that conducts electricity using electrons and/or ions as charge carriers—such as carbon black arranged in a matrix material, conductive metal oxide particles, or an ion conductive agent—can be used as a conductive agent for the purpose of adjusting the resistance.

The conductive metal oxide particles that are conductive particles for adjusting the resistance are conductive particles such as tin oxide, tin oxide doped with antimony, zinc oxide, anatase titanium oxide, and indium tin oxide (ITO). Any agent can be used as long as it is a conductive agent where electrons serve as charge carriers, and the conductive metal oxide particles are not particularly limited. These can be used singly, or two or more different types can be used together. Further, although the conductive metal oxide particles may be of any particle diameter as they do not inhibit the present invention, tin oxide, tin oxide doped with antimony, and anatase titanium oxide are preferable in terms of resistance adjustment and strength, and tin oxide and tin oxide doped with antimony are particularly preferable.

By controlling the resistance with this conductive material, stable characteristics are obtained without the resistance of the surface layer changing due to environmental conditions.

Moreover, fluorine or silicone resin is used in the surface layer. In particular, it is preferable for the resin to be configured by a fluorine degeneration acrylate polymer. Microparticles may also be added to the surface layer. Thus, the microparticles act such that the surface layer becomes hydrophobic and the adherence of foreign matter to the charge roll 14 is prevented. It is also possible to add insulating particles such as alumina or silica to impart unevenness to the surface of the charge roll 14, reduce the burden when the surface layer rubs the photoconductor drum 12, and improve abrasion resistance between the charge roll 14 and the photoconductor drum 12.

Next, the attachment structure of the charge roll 14 and the cleaning roll 100 will be described in detail.

Figure 3:
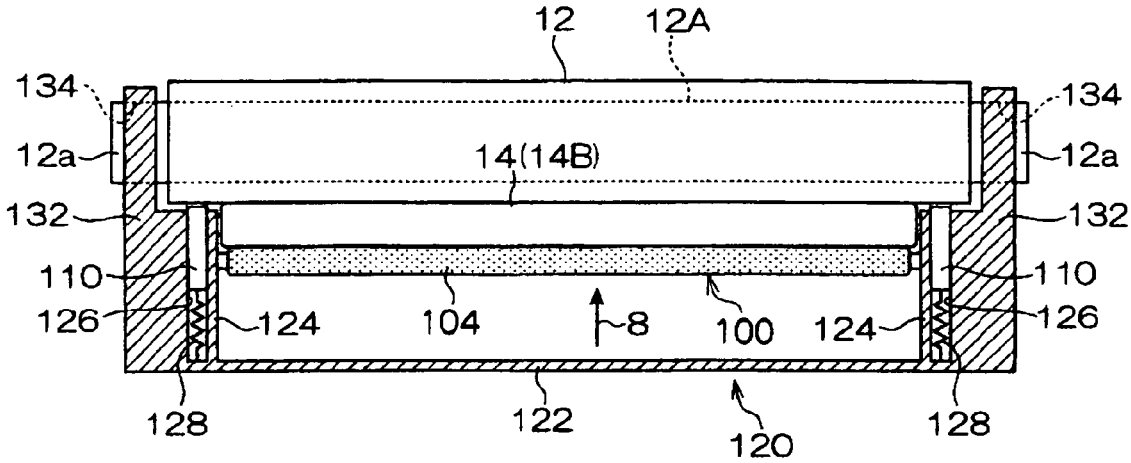
FIG. 3 is a partial sectional front view showing the configuration of an attachment structure of the photoconductor drum, the charge roll and the cleaning roll in the image forming apparatus pertaining to the exemplary embodiment of the invention.

As shown in FIG. 3, in the present exemplary embodiment, the charge roll 14 and the cleaning roll 100 are attached to a single frame 120 via a pair of bearing members 110 and are housed inside the frame 120. The photoconductor drum 12 is also attached to the frame 120, and these are unitized.

Figure 4B:
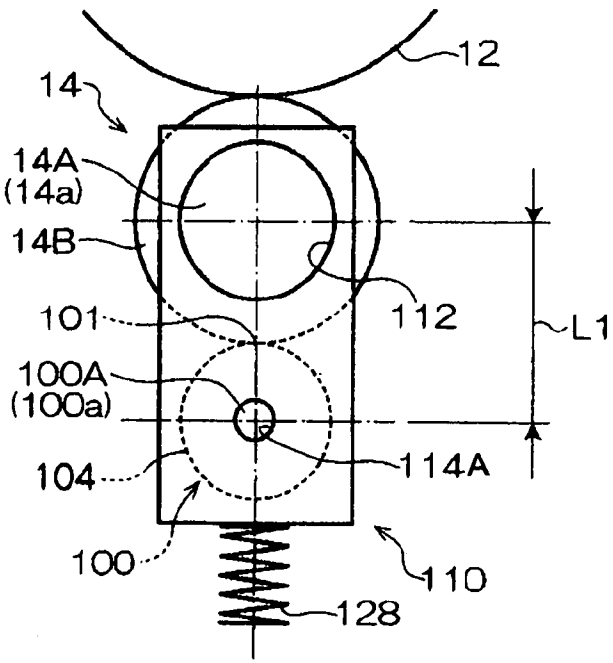
FIG. 4B is a side view showing the state where the charge roll and the cleaning roll configuring the image forming apparatus pertaining to the exemplary embodiment of the invention are supported on the bearing member.
Figure 4A:
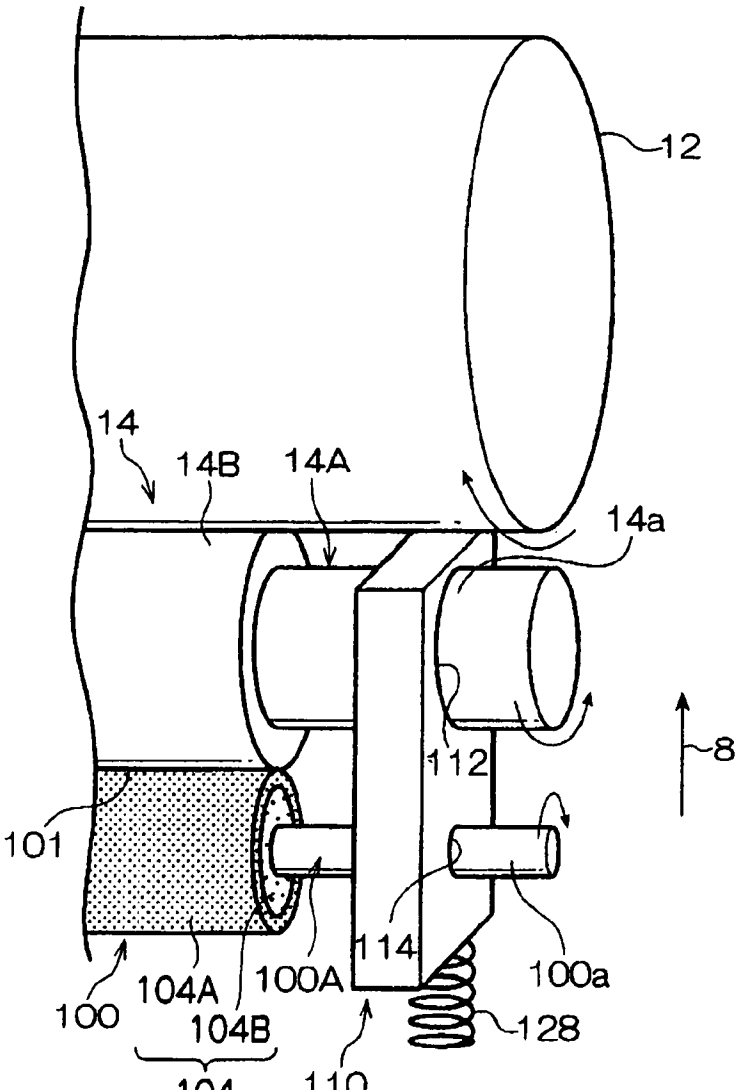
FIG. 4 A is a perspective view showing a state where the charge roll and the cleaning roll configuring the image forming apparatus pertaining to the exemplary embodiment of the invention are supported on a bearing member.

As shown in FIGS. 4A and 4B, one of the bearing members 110 is formed in a flat rectangular parallelepiped shape (block shape) and has a single configuration. This bearing member 110 is formed by a synthetic resin material such as polyacetal or polycarbonate that is rigid, slidable, and has excellent resistance to abrasion. Further, the synthetic resin material may also include glass fiber or carbon fiber in order to further raise its resistance to abrasion.

Two bearing holes 112 and 114, between which a predetermined interval L1 is disposed along the longitudinal direction (vertical direction in FIGS. 4A and 4B), are formed in the bearing member 110. A support portion 14*a* disposed on the end portion of the shaft 14A of the charge roll 14 is rotatably inserted through the bearing hole 112, and a support portion 100*a* disposed on the end portion of the shaft 100A of the cleaning roll 100 is rotatably inserted through the other bearing hole 114. Further, as is shown, the inner diameter of the bearing hole 114 is configured to be larger than the shaft diameter of the shaft 100A (support portion 100*a*).

The support portions 14*a* at both ends of the shaft 14A of the charge roll 14 and the support portions 100*a* at both ends of the shaft 100A of the cleaning roll 100 are rotatably supported in the pair of bearing members 110. Additionally, the cleaning roll 100 is pressed with a predetermined load against the charge roll 14, whereby the sponge 104 is elastically deformed along the circumferential surface of the charge roll 14 to form the nip portion 101, as described above (see FIG. 2).

The relative positions of the charge roll 14 and the cleaning roll 100 are maintained at a substantial constant, and the cleaning roll 100 is pressed with a predetermined load against the charge roll 14, whereby the support portion 100*a* of the shaft 100A of the cleaning roll 100 is brought into contact with and supported by an inner peripheral surface portion 114A of the bearing hole 114 opposite from the charge roll 14.

Additionally, as described above, the sponge 104 is elastically deformed along the peripheral surface of the charge roll 14 and forms the nip portion 101 (see FIG. 2). Further, the bearing holes 114 that contact and support the support portions 100*a* of the shaft 100A of the cleaning roll 100 are configured to have shapes that impart a degree of freedom to the pressing direction toward the charge roll 14 (the direction of arrow 8) with respect to the support portions 100*a* of the shaft 100A.

As shown in FIG. 3, a pair of attachment portions 124, to which the pair of bearing members 110 are attached, is integrally disposed on both end portions (left and right side end portions in FIG. 3) of a body portion 122 of the frame 120 along the axial direction of the charge roll 14 and the cleaning roll 100.

Guide grooves 126 along the extension direction of the attachment portions 124 are formed in the attachment portions 124. The bearing members 110 are configured to be fitted into the guide grooves 126 and disposed in the leading end sides thereof, such that the bearing members 110 may be guided in the guide grooves 126 and slide along the extension direction of the attachment portions 124 (the direction toward and away from the photoconductor drum 12).

The outer sides of the pair of attachment portions 124 are thick, the leading end sides extend, and a pair of bearing portions 132 that support the photoconductor drum 12 are disposed on the leading end sides. Bearing holes 134 are coaxially formed in the pair of bearing portions 132. Support portions 12*a* disposed on end portions of a shaft 12A of the photoconductor drum 12 are rotatably inserted into the bearing holes 134, whereby the photoconductor drum 12 is attached to the frame 120 together with the charge roll 14 and the cleaning roll 100.

Further, compression coil springs 128 that bias the bearing members 110 toward the photoconductor drum 12 are disposed inside base ends of the guide grooves 126. The bearing members 110 are biased toward the photoconductor drum 12 (the direction of arrow 8) and the charge roll 14 is pushed against the photoconductor drum 12 by the spring force of the compression coil springs 128. Thus, when the photoconductor drum 12 rotates, the charge roll 14 rotates following the rotation of the photoconductor drum 12 and charges the photoconductor drum 12, and the cleaning roll 100 rotates following the rotation of the charge roll 14 and cleans the charge roll 14.

Next, the action of the present exemplary embodiment will be described.

Figure 5A:
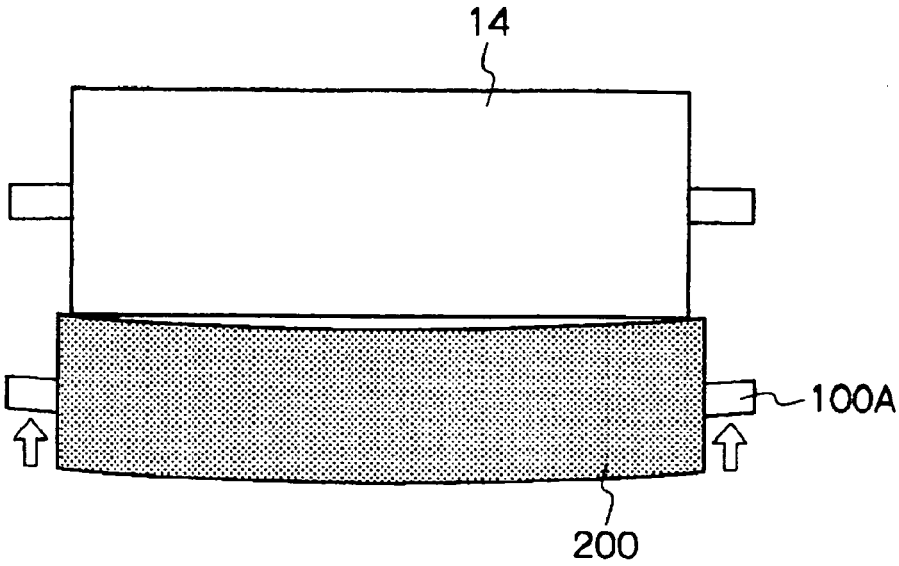
FIG. 5A is a comparative example for describing a sectional front view showing the action of the cleaning roll configuring the image forming apparatus pertaining to the exemplary embodiment of the invention.
Figure 5B:
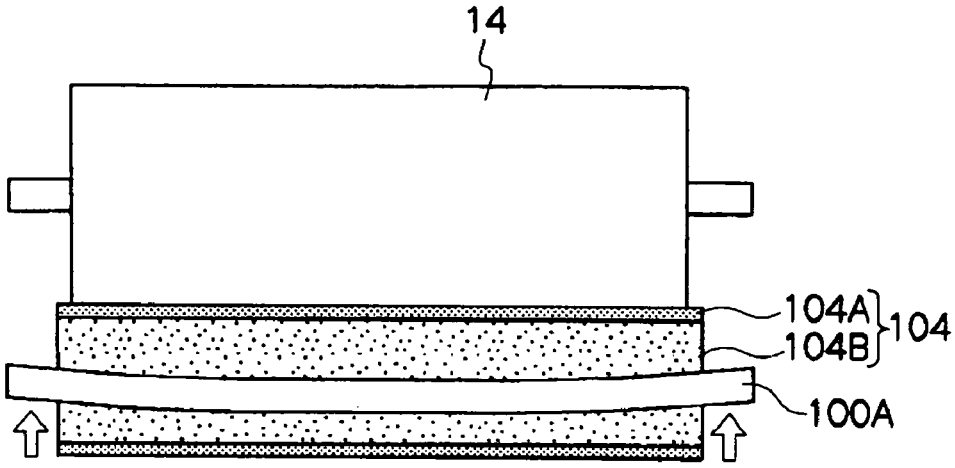
FIG. 5B is a sectional front view showing the action of the cleaning roll configuring the image forming apparatus pertaining to the exemplary embodiment of the invention.
Figure 5C:
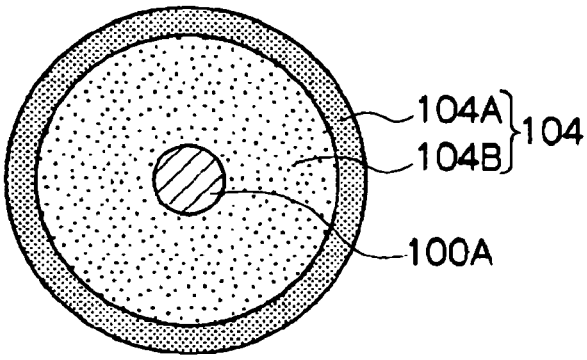
FIG. 5C is a sectional view showing the action of the cleaning roll configuring the image forming apparatus pertaining to the exemplary embodiment of the invention.

In the present invention, as shown in FIGS. 5B and 5C, the sponge 104 disposed on the outer peripheral surface of the shaft 100A of the cleaning roll 100 has a two-layer structure, and the hardness of the surface (the surface layer 104A) of the sponge 104 is harder than the hardness of the axial core (inner layer 104B) of the sponge 104.

As shown in FIG. 5A, because a sponge 200 is used in a state where it is pressed against the charge roll 14, the reaction force of the sponge 200 is applied to the shaft 100A, and the shaft 100A becomes deformed by that reaction force.

When the state of contact (nip width) between the sponge 200 and the charge roll 14 becomes uneven in the axial direction of the charge roll 14, the sponge 200 cannot uniformly remove contamination on the charge roll 14, the contamination remains on the surface of the charge roll 14, the charge roll 14 becomes unable to uniformly charge the photoconductor drum 12, and unevenness in the image quality to be outputted occurs.

For this reason, as shown in FIGS. 5B and 5C, the inner layer 104B that is formed by a soft sponge is disposed on the axial core of the cleaning roll 100, whereby the bending amount of the shaft 100A can be absorbed by the inner layer 104B, affects on the surface layer 104A of the sponge 104 can be eliminated, and the state of contact between the cleaning roll 100 and the charge roll 14 can be uniformly maintained. Thus, excellent capability of the cleaning roll 100 to clean the charge roll 14 can be obtained. Further, because the bending amount of the shaft 100A is absorbed, the diameter of the shaft 100A can be made small and the image forming apparatus 10 can be made compact.

Figure 6:
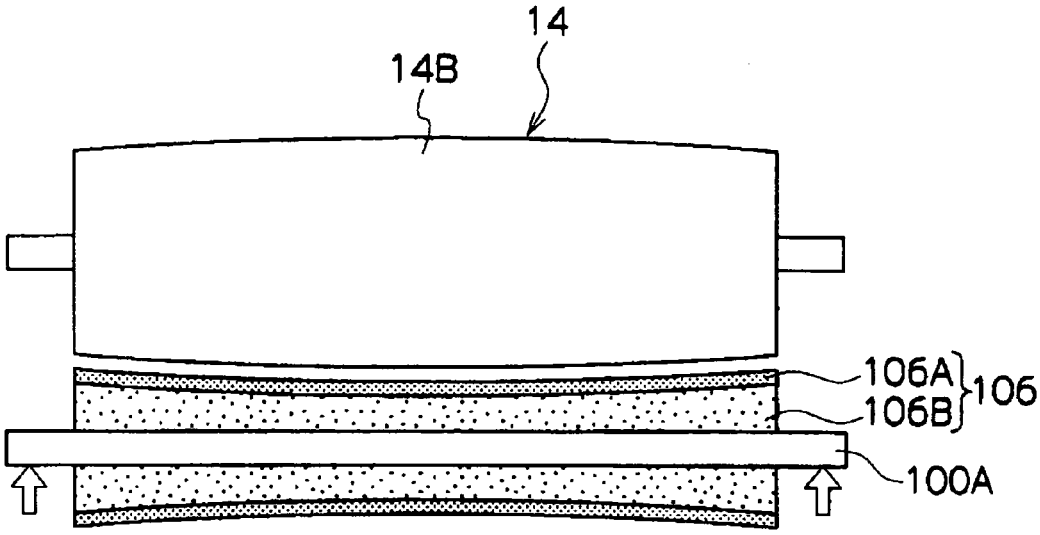
FIG. 6 is a first modification showing the action of the cleaning roll configuring the image forming apparatus pertaining to the exemplary embodiment of the invention.

Here, as shown in FIGS. 2 and 3, the cylindrical charge layer 14B is disposed on the outer peripheral surface of the shaft 14A of the charge roll 14, but as shown in FIG. 6, when the charge layer 14B has a crown shape where the outer diameter of the center portion in the axial direction is larger than the outer diameter of the end portions, a sponge 106 configured by a surface layer 106A and an inner layer 106B may be formed to match this crown shape, and the thickness of the inner layer 106B may be changed to make the axial-direction center portion of the sponge 106 thinner than the end portions.

Figure 7:
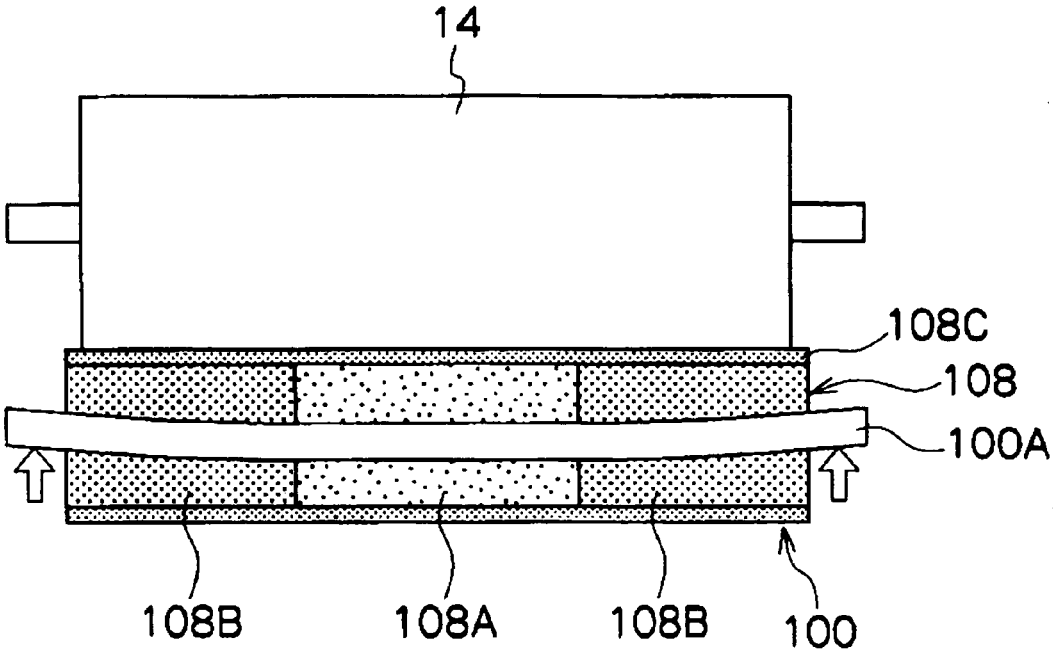
FIG. 7 is a second modification showing the action of the cleaning roll configuring the image forming apparatus pertaining to the exemplary embodiment of the invention.

Further, here, as shown in FIG. 5B, the inner layer 104B is disposed on the outer peripheral surface of the shaft 100A of the cleaning roll 100 and the surface layer 104A is disposed on the outer peripheral surface of the inner layer 104B to give the sponge 104 a two-layer structure, but it is not necessary to limit the sponge 104 to two layers. As shown in FIG. 7, the hardness of a sponge 108 may be changed in the longitudinal direction of the sponge 108.

Because the reaction force received from the charge roll 14 is larger at the axial-direction center portion of the sponge 108, the hardness of an axial-direction center portion 108A of the sponge 108 (e.g., hardness of 29.4 to 49 N) is made lower (by using a softer material for the center portion 108A) than the hardness of end portions 108B (e.g., hardness of 49 to 98 N), and at the center portion 108A, the absorption rate of the reaction force received from the charge roll 14 is raised to lower the affects on a surface layer 108C (e.g., hardness of 127 to 166 N) of the sponge 108.

Figure 8A:
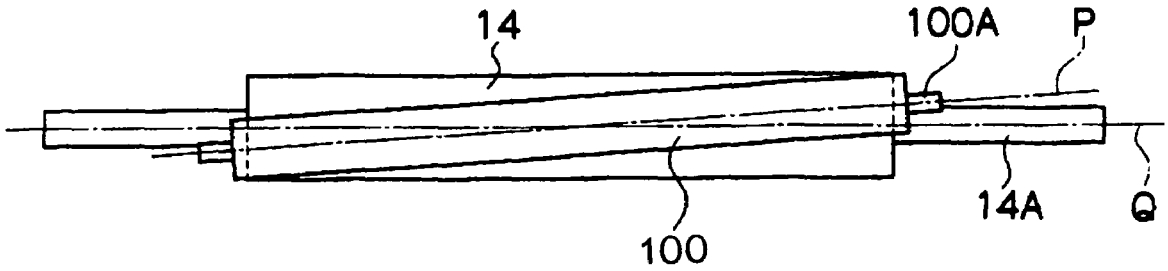
FIG. 8A is a bottom view of a third modification showing the action of the cleaning roll configuring the image forming apparatus pertaining to the exemplary embodiment of the invention.
Figure 8B:
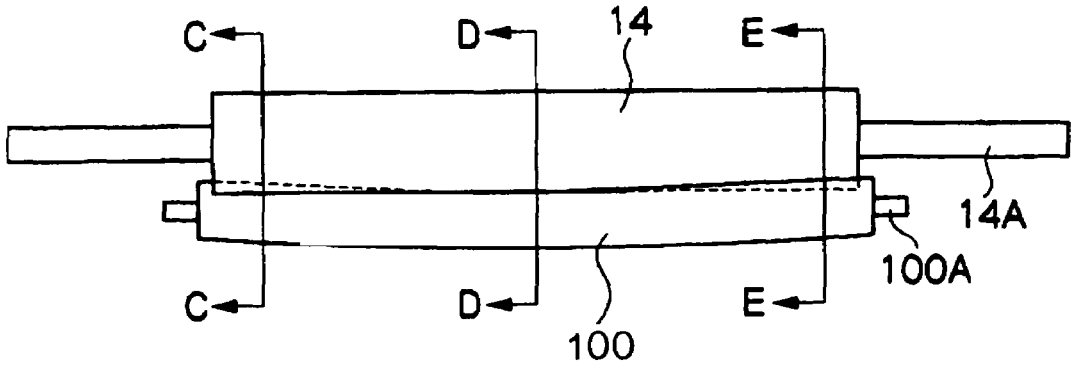
FIG. 8B is a front view of the third modification showing the action of the cleaning roll configuring the image forming apparatus pertaining to the exemplary embodiment of the invention.
Figure 8C:
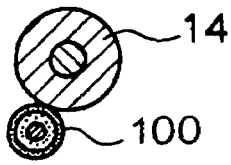
FIG. 8C is a sectional view of the third modification at C-C in FIG. 8B showing the action of the cleaning roll configuring the image forming apparatus pertaining to the exemplary embodiment of the invention.
Figure 8D:
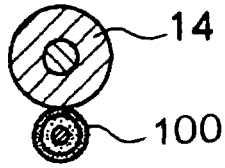
FIG. 8D is a sectional view of the third modification at D-D in FIG. 8B showing the action of the cleaning roll configuring the image forming apparatus pertaining to the exemplary embodiment of the invention.
Figure 8E:
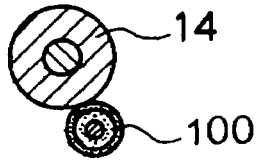
FIG. 8E is a sectional view of the third modification at E-E in FIG. 8B showing the action of the cleaning roll configuring the image forming apparatus pertaining to the exemplary embodiment of the invention.

Further, as shown in FIGS. 8A to 8C, the cleaning roll 100 may be disposed such that an axial line P of the shaft 100A of the cleaning roll 100 is caused to intersect an axial line Q of the shaft 14A of the charge roll 14. FIG. 8A is a bottom view showing the disposition of the cleaning roll 100 and the charge roll 14, FIG. 8B is a front view showing the disposition of the cleaning roll 100 and the charge roll 14, and FIGS. 8C to 8E are cross-sectional views of FIG. 8B.

By causing the axial line P of the shaft 100A of the cleaning roll 100 to intersect the axial line Q of the shaft 14A of the charge roll 14 in this manner, the nip width can be made uniform in the axial direction of the sponge 104 even if the center portion of the shaft 100A becomes bent because the sponge 104 wraps around the surface of the charge roll 14. Thus, the cleaning performance due to the sponge 104 can be further improved.

Figure 9:
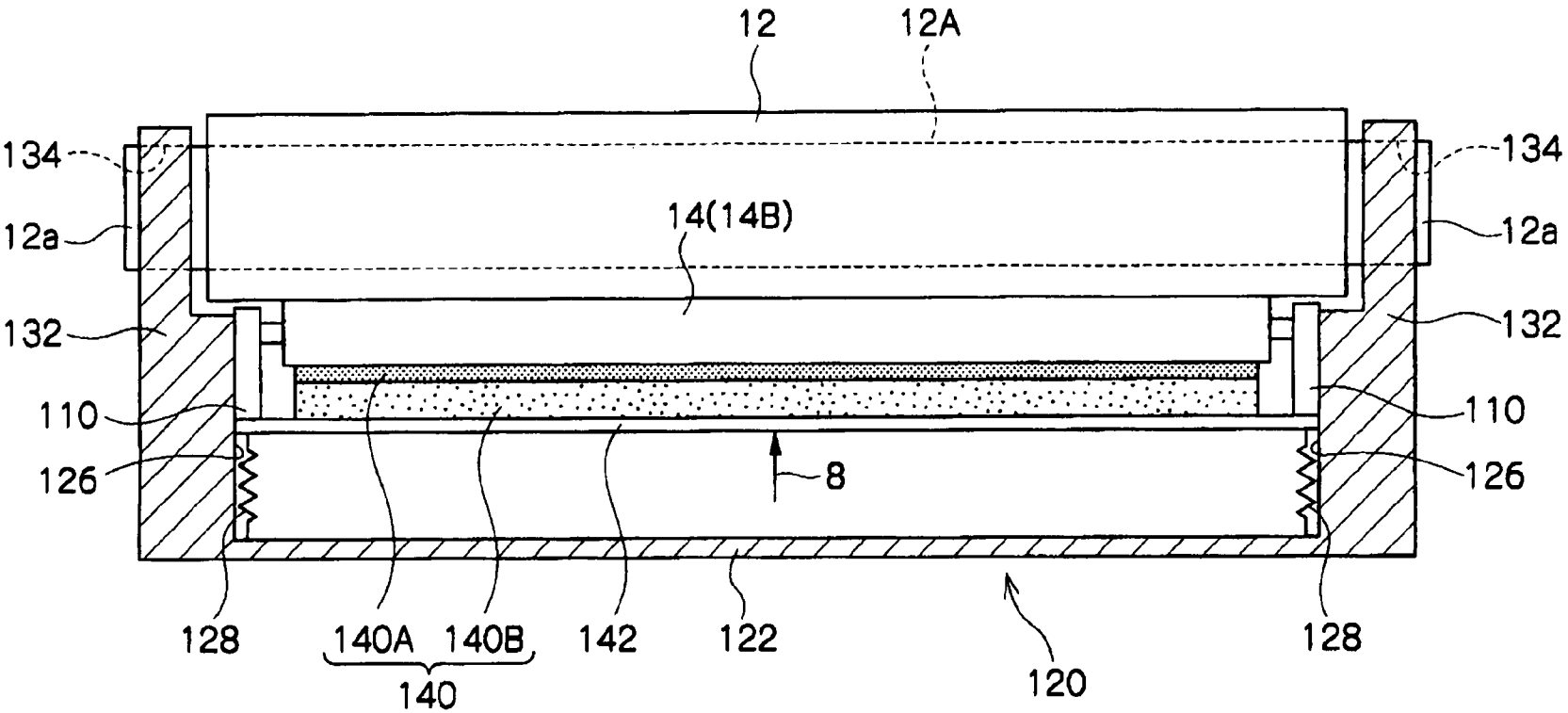
FIG. 9 is a fourth modification showing the configuration of the attachment structure of the photoconductor drum, the charge roll and the cleaning roll in the image forming apparatus pertaining to the exemplary embodiment of the invention.

In the present exemplary embodiment, the roll-like sponge 104 is described as an example of the elastic member, but the elastic member is not limited to this. For example, as shown in FIG. 9, a layer-like sponge member 140 that has a plate-like shape may also be used. The sponge member 140 is disposed separately from the charge roll 14 and is supported by a holder 142 disposed facing the charge roll 14.

Figure 10A:
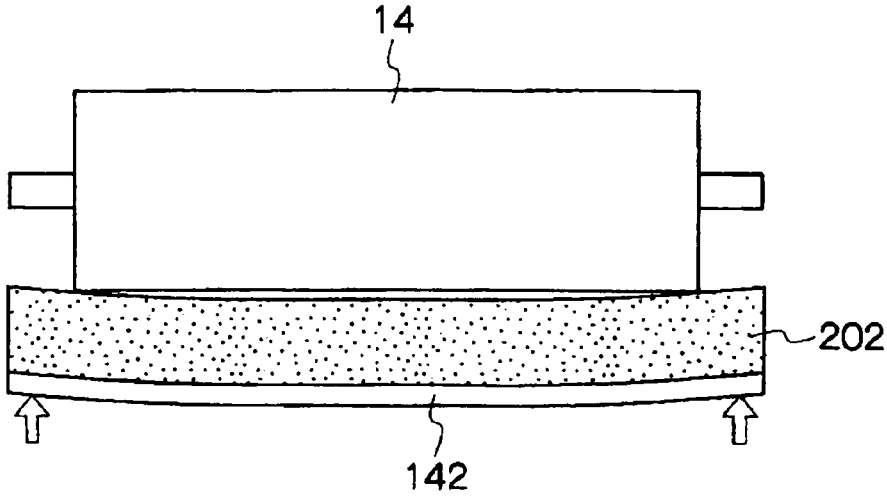
FIG. 10A is a descriptive diagram showing the action of the cleaning roll of FIG. 9.
Figure 10B:
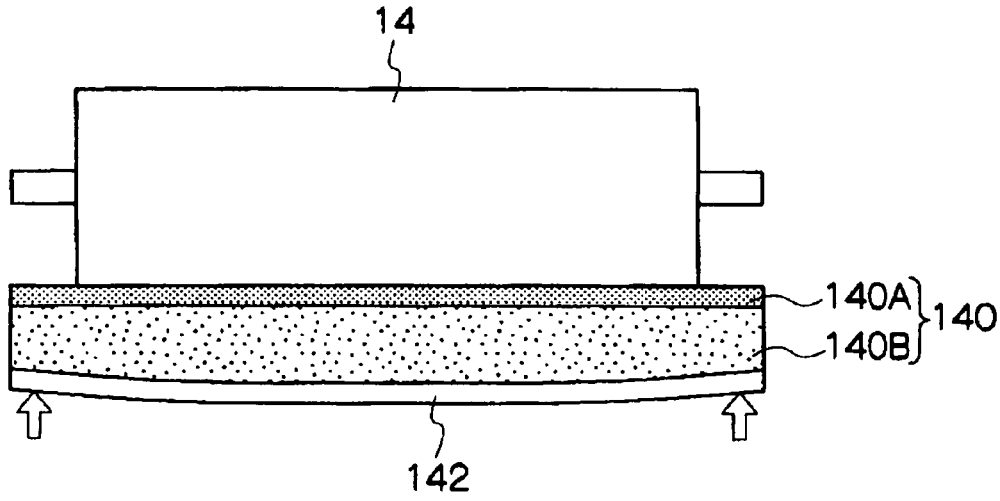
FIG. 10B is a descriptive diagram showing the action of the cleaning roll of FIG. 9.

Additionally, the hardness (e.g., 127 to 166 N) of an upper layer portion 140A of the sponge member 140 contacting the charge roll 14 is configured to be higher than the hardness (e.g., 29.4 to 68.6 N) of a lower layer portion 140B, so that in comparison to a single layer sponge material 202 as shown in FIG. 10A, bending of the holder 142 is absorbed by the lower layer portion 140B as shown in FIG. 10B to reduce affects on the upper layer portion 140A resulting from the bending of the holder 142. Thus, the state of contact between the sponge member 140 and the charge roll 14 can be uniformly maintained and the cleaning performance due to the sponge member 140 can be improved.

Figure 11:
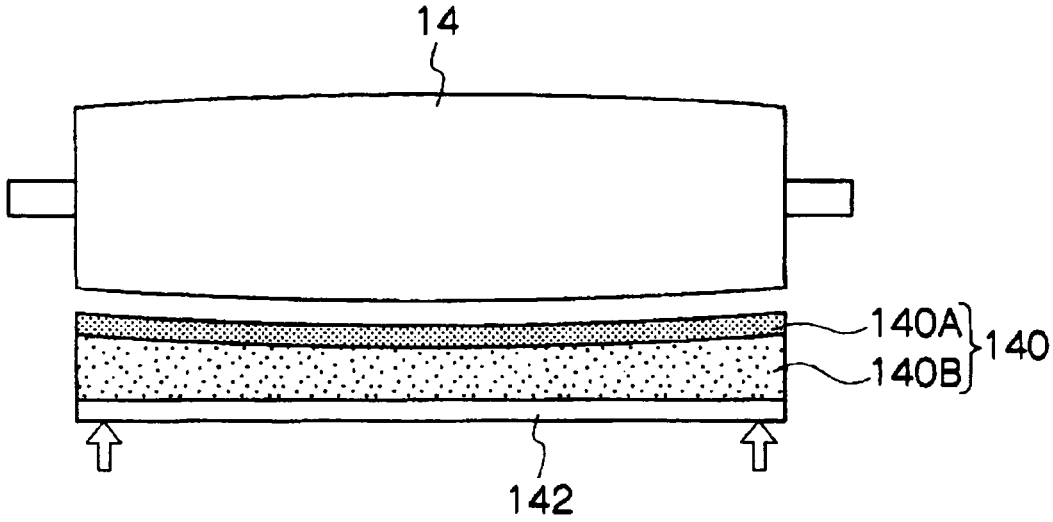
FIG. 11 is a descriptive diagram showing the action of the cleaning roll configuring the image forming apparatus pertaining to the exemplary embodiment of the invention, and is a fifth modification.

Further, as shown in FIG. 11, when the charge roll 14 has a crown shape, the sponge member 140 may be formed to match the crown shape in the same manner as in FIG. 6.

Figure 12:
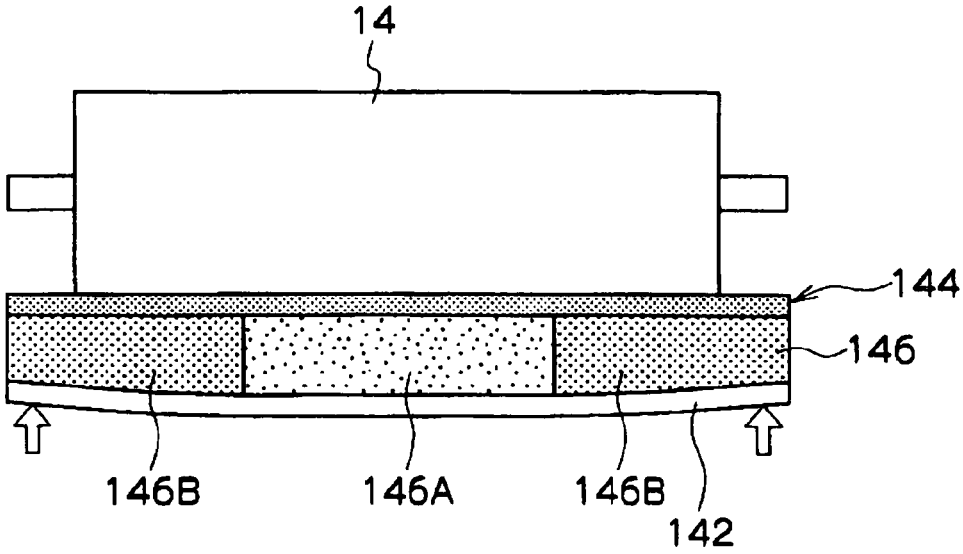
FIG. 12 is a descriptive diagram showing the action of the cleaning roll configuring the image forming apparatus pertaining to the exemplary embodiment of the invention, and is a sixth modification.

Moreover, as shown in FIG. 12, the hardness of a center portion 146A may be configured to be less than the hardness of both end portions 146B in the lower layer portion 146 of the sponge member 144 in a same manner as in FIG. 7.

Further, here, a sponge is used as an example of the elastic member, but it is not necessary for the elastic member to be porous because it suffices for the elastic member to be able to contact and clean the charge roll 14.

The present invention has been described in detail by way of exemplary embodiments, but the present invention is not limited to these. Various other embodiments are implementable within the scope of the invention.

For example, a configuration is described where the charge roll 14 is brought into contact with the underside of the photoconductor drum 12 and the cleaning roll 100 is brought into contact with the underside of the charge roll 14, but the positional relationship between the photoconductor drum 12, the charge roll 14, and the cleaning roll 100 is not limited to this. For example, the present invention can also be applied to a configuration where the charge roll 14 is brought into contact with the upper side of the photoconductor drum 12 and the cleaning roll 100 is brought into contact with the upper side of the charge roll 14. Moreover, the present invention can be applied even when the charge roll 14 does not contact the photoconductor drum 12.

Moreover, the image forming apparatus applying the present invention is not limited to a 4-cycle configuration where the rotary developing unit 18 is used to repeatedly conduct 4 times the formation of toner images on the photoconductor drum 12. For example, even in a configuration where image forming units of yellow, magenta, cyan, and black are arranged in a row along the moving direction of the intermediate transfer belt 20, the present invention can be applied to the photoconductor drum 12, the charge roll 14, and the cleaning roll 100 of each image forming unit.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries an image;

a charge roll that charges the image carrier; and a cleaning member that contacts the charge roll and cleans the charge roll, wherein the cleaning member is configured to include a surface layer that is formed by an elastic body and contacts the charge roll, an inner layer that is configured by an elastic body softer than the surface layer and supports the surface layer, and a support member that supports the inner layer and causes the surface layer to contact the charge roll.

2. The image forming apparatus of claim 1, wherein the support member is a shaft, the inner layer is formed on an outer peripheral surface of the shaft, and the surface layer is formed on an outer peripheral surface of the inner layer.

3. The image forming apparatus of claim 2, wherein the thickness of the inner layer is changed to give the outer shape of the surface layer a shape along the axial direction of the charge roll.

4. The image forming apparatus of claim 2, wherein the hardness of the inner layer is changed in the longitudinal direction of the inner layer.

5. The image forming apparatus of claim 2, wherein an axial line of the support member is caused to intersect an axial line of the charge roll.

6. The image forming apparatus of claim 1, wherein the support member is a plate material, the inner layer is formed on an upper surface of the plate material, and the surface layer is formed on an upper surface of the inner layer.

7. The image forming apparatus of claim 6, wherein the hardness of the inner layer is changed in the longitudinal direction of the inner layer.

8. The image forming apparatus of claim 1, wherein the thickness of the inner layer is changed to give the outer shape of the surface layer a shape along the axial direction of the charge roll.

9. The image forming apparatus of claim 1, wherein the hardness of the inner layer is changed in the longitudinal direction of the inner layer.

10. The image forming apparatus of claim 1, wherein an axial line of the support member is caused to intersect an axial line of the charge roll.

* * * * *